US010337254B2

(12) United States Patent
Nguyen

(10) Patent No.: US 10,337,254 B2
(45) Date of Patent: Jul. 2, 2019

(54) TUNGSTEN CARBIDE INSERT BIT WITH MILLED STEEL TEETH

(71) Applicant: PDB Tools, Inc., Grapevine, TX (US)

(72) Inventor: Nam Duy Nguyen, Lewisville, TX (US)

(73) Assignee: PDB Tools, Inc., Grapevine, TX (US)

( * ) Notice: Subject to any disclaimer, the term of this patent is extended or adjusted under 35 U.S.C. 154(b) by 308 days.

(21) Appl. No.: 14/960,250

(22) Filed: Dec. 4, 2015

(65) Prior Publication Data

US 2017/0159366 A1 Jun. 8, 2017

(51) Int. Cl.
*E21B 10/52* (2006.01)
*E21B 10/16* (2006.01)
*E21B 10/08* (2006.01)

(52) U.S. Cl.
CPC ..... *E21B 10/52* (2013.01); *E21B 10/08* (2013.01)

(58) Field of Classification Search
CPC ..... E21B 10/52; E21B 10/16; E21B 10/50
See application file for complete search history.

(56) References Cited

U.S. PATENT DOCUMENTS 1,871,736 A * 8/1932 Reed ..... E21B 10/16 175/340
1,885,085 A * 10/1932 Dalzen ..... E21B 10/52 175/374
2,121,202 A * 6/1938 Killgore ..... E21B 10/006 175/374
2,168,060 A * 8/1939 Catland ..... E21B 10/50 175/375
2,244,617 A 6/1941 Hannum
3,126,067 A 3/1964 Schumacher, Jr.
3,401,759 A * 9/1968 White ..... E21B 10/16 175/341
3,599,737 A * 8/1971 Fischer ..... E21B 10/52 175/324
4,108,260 A 8/1978 Bozarth
4,320,808 A * 3/1982 Garrett ..... E21B 10/16 175/340
4,630,692 A * 12/1986 Ecer ..... B22F 3/15 172/747
5,421,423 A * 6/1995 Huffstutler ..... E21B 10/16 175/374
5,445,231 A * 8/1995 Scott ..... E21B 10/50 175/374

(Continued)

*Primary Examiner* — Kipp C Wallace
(74) *Attorney, Agent, or Firm* — Mark W Handley; Handley Law Firm, PLLC

(57) ABSTRACT

An earth boring bit has rotary cutters with embedded tungsten carbide inserts and milled steel teeth. The teeth and the grooves are first milled into the cutters, with the grooves extending between bases of the teeth, parallel to the crests of the teeth. Hard facing is applied to surfaces of the teeth and the grooves, and then the cutters are heat treated. Insert sockets are drilled into the teeth, centrally disposed in crests of the teeth. The tungsten carbide inserts are secured in the insert sockets, aligned for forming cutting profiles with respective ones of the milled teeth. The cutters are preferably frustoconically shaped and used for a rotary cone rock bit, and the tungsten carbide inserts configured as chisel-shaped inserts having crests which are aligned parallel to the crests of the milled steel teeth.

18 Claims, 4 Drawing Sheets

(56) References Cited

U.S. PATENT DOCUMENTS

| | | | | | |
|---|---|---|---|---|---|
| 5,676,214 | A * | 10/1997 | Pearce | E21B 10/18 | 175/340 |
| 5,678,645 | A * | 10/1997 | Tibbitts | E21B 10/5673 | 175/426 |
| 6,029,759 | A * | 2/2000 | Sue | E21B 10/16 | 175/374 |
| 6,116,359 | A * | 9/2000 | Prejean | E21B 10/16 | 175/341 |
| 6,209,668 | B1 | 4/2001 | Pessier et al. | | |
| 6,595,304 | B2 * | 7/2003 | Chen | E21B 10/16 | 175/377 |
| 2009/0260890 | A1 * | 10/2009 | Buske | E21B 10/16 | 175/374 |

* cited by examiner

TUNGSTEN CARBIDE INSERT BIT WITH MILLED STEEL TEETH

TECHNICAL FIELD OF THE INVENTION

The present invention relates in general to earth boring bits, and in particular to rock bits having tungsten carbide inserts mounted in milled steel teeth.

BACKGROUND OF THE INVENTION

Earth boring bits such as rock bits for the oil field and mining industries have long been provided by rotary drill bits having milled steel teeth formed on rotary cone cutters in circumferentially extending rows. The height of the milled teeth are measured from a base to a crest. The softer the rock, the larger the height of the teeth which may be used, providing for more aggressive rock bits capable of drilling more quickly through the softer earth formations. In harder formations less aggressive bits are used having teeth of smaller height. Cutting surfaces for rock bits have also been provided by embedding inserts into rotary cutters and bit bodies. Tungsten carbide inserts ("TCI") and polycrystalline diamond compacts ("PDC") have been used. The tungsten carbide inserts typically have a tungsten carbide insert body with one end formed to provide a cutting surface. The PDC inserts typically have an insert body formed of tungsten carbide with one end having a polycrystalline diamond cutting surface.

For rotary cone rock bits, the tungsten carbide insert bodies typically extend outward of the rotary cutters in a cantilevered arrangement. Compressive and torsional loads on the cantilevered insert bodies often lead to failure. Erosion of steel material of the rotary cutters from around the insert bodies is also a common failure mode. Increasing the amount of steel material of the rotary cutters around the insert bodies can provide more material for erosion and reduce the cantilevered length the insert bodies extend, reducing the compressive and torsional loads to provide longer service life for the bit. Although service life is increased, increasing the amount of cutter material around the insert bodies reduces an effective tooth height for the inserts which provides a less aggressive bit, reducing the speed at which the bit will move through earthen formations.

One example of an earth boring bit is the rotary cone rock bit. Rotary cone rock bits have a bit body with an upper end adapted for connection to a drill string and typically three bit legs which extend downward from the body to provide support arms. A bearing shaft extends inward and downward from each bit leg. A conventional rock bit bearing shaft is cylindrical and rotatably receives a rotary cutter provided by a cutter cone. The cutter cone is generally mounted on each bearing shaft and supported rotatably on bearings acting between the spindle and the inside of a spindle-receiving cavity in each cutter cone. The cutter cones have teeth, inserts or compacts on their exteriors for disintegrating earth formations as the cones rotate on the bearing shafts. One or more fluid nozzles are often formed on the underside of the bit body. The nozzles are typically positioned to direct drilling fluid passing downwardly from the drill string toward the bottom of the borehole being drilled. Drilling fluid washes away material removed from the bottom of the borehole and cleanses the cutter cones, carrying the cuttings and other debris radially outward and then upward within an annulus defined between the drill bit and the wall of the borehole.

SUMMARY OF THE INVENTION

An earth boring bit has cutters with embedded tungsten carbide inserts and milled steel teeth. The teeth are first milled into the cutters and grooves are milled to extend between bases of the teeth, parallel to the crests of the teeth. Hard facing is applied to surfaces of the teeth and the grooves, and then the cutters are heat treated. Insert sockets are drilled into the teeth, centrally disposed in crests of the teeth. The tungsten carbide inserts are secured in the insert sockets, aligned for forming cutting profiles with respective ones of the milled teeth. The cutters are preferably frusto-conically shaped and used for a rotary cone rock bit, and the tungsten carbide inserts configured as chisel-shaped inserts having crests which are aligned parallel to the crests of the milled steel teeth.

DESCRIPTION OF THE DRAWINGS

For a more complete understanding of the present invention and the advantages thereof, reference is now made to the following description taken in conjunction with the accompanying Drawings in which

FIG. 1 is a perspective view of the earth boring drill bit having rotary cutters;

FIG. 2 is a one-quarter longitudinal section view of the drill bit;

FIGS. 3, 4 and 5 are side views of cutters for the drill bit;

FIG. 6 is a partial view of one of the cutters showing a side view of the nose section of the cutter;

FIG. 7 is a fragmentary partial view of a section of one of the cutters; and FIG. 8 is a sectional view of the cutter, taken along section line 8-8 of FIG. 7.

DETAILED DESCRIPTION OF THE INVENTION

Figure 1:
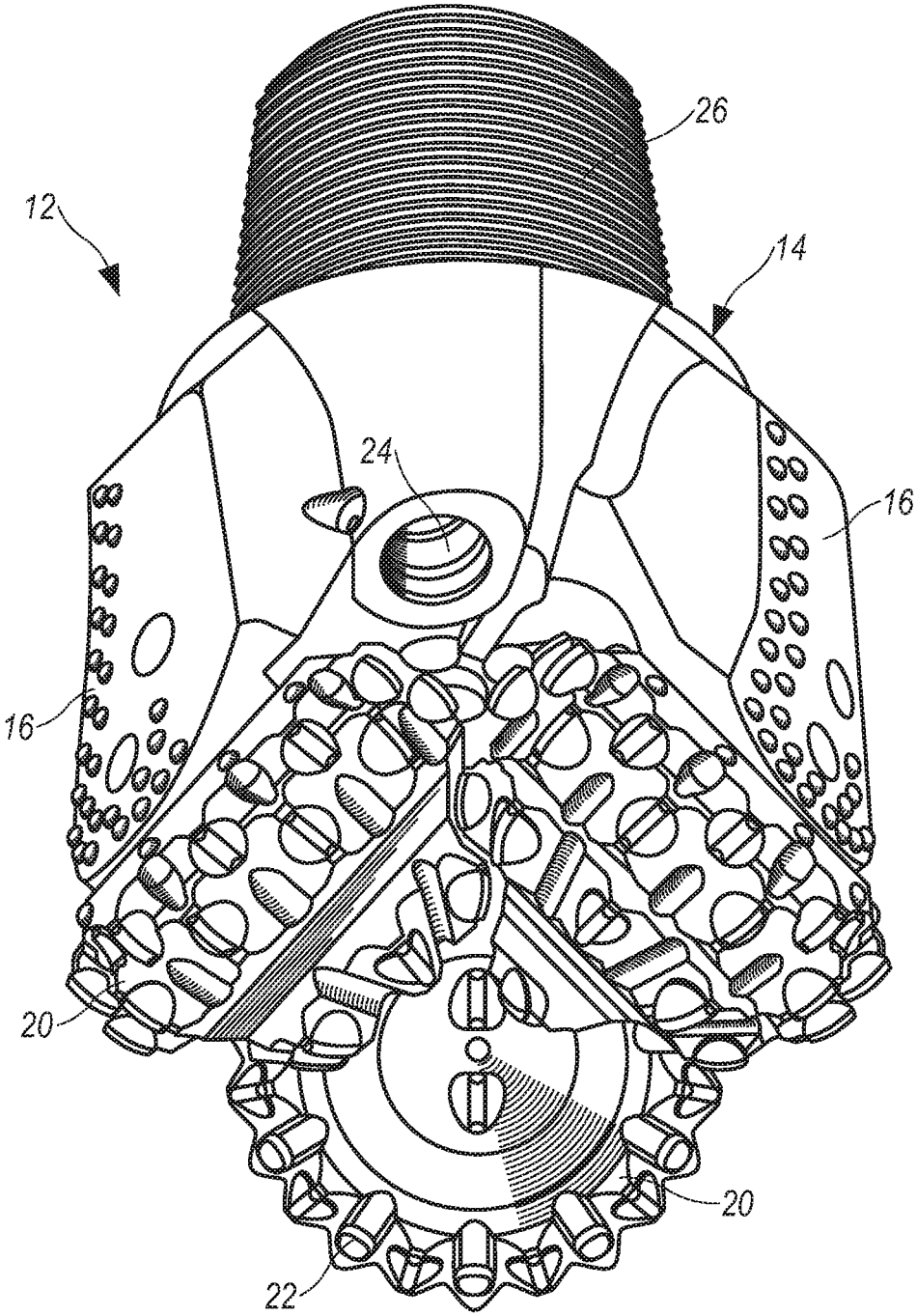
FIGS. 1 through 8 show various aspects for an earth boring drill bit having tungsten carbide inserts embedded in milled steel teeth according to the present disclosure, as set forth below.

FIG. 1 is a perspective view of the earth boring drill bit 12 having a bit body 14 with three legs 16. The legs 16 extend downward from a main portion of the bit body 14. Rotary cutters 20 are rotatably mounted to the legs 16 by means of bearing shafts 18 (shown in FIG. 2). The cutters 20 have teeth 22 provided by tungsten carbide inserts ("TCI") 32 embedded in milled steel teeth 34. A nozzle bore 24 is provided in the lower end of the bit body 14 for receiving a flow nozzle and passing drilling fluid onto the cutters 20. The bit body 14 has a threaded pin connection end 26 at its upper end for connecting to a drill string.

Figure 2:
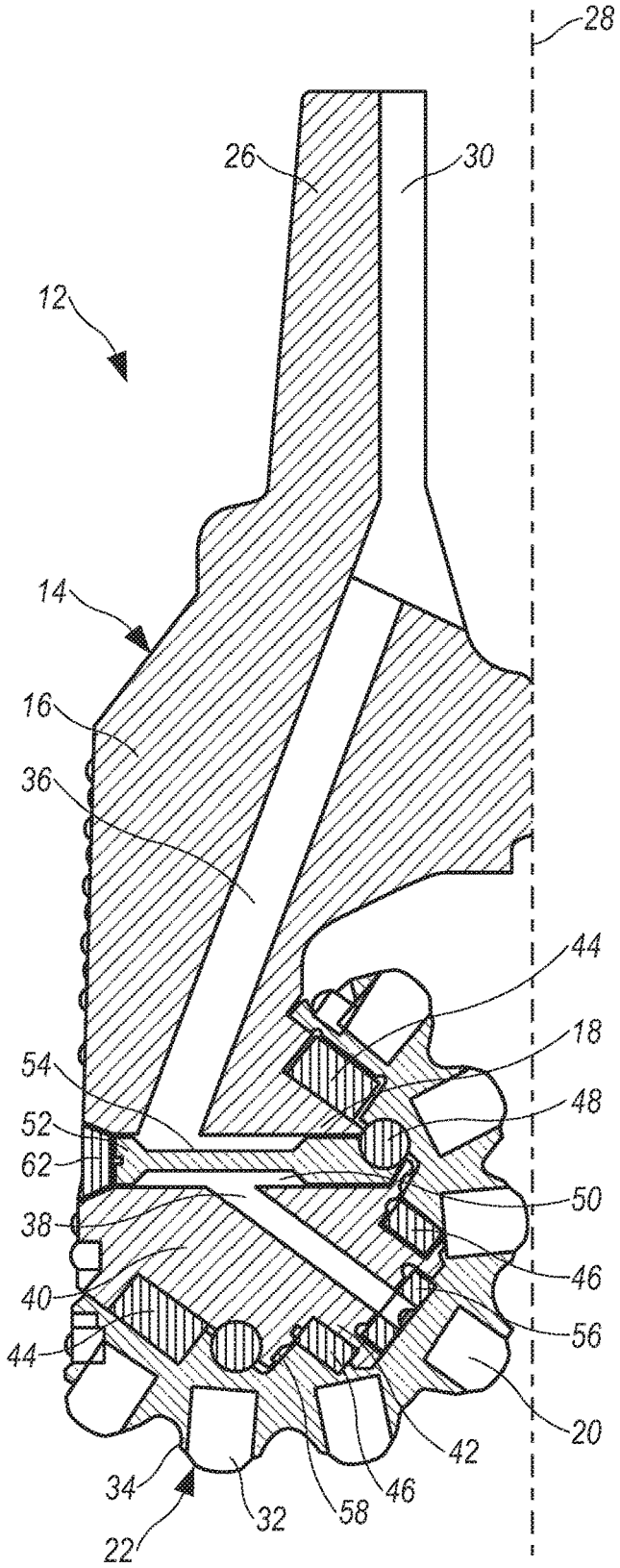

FIG. 2 is a one-quarter longitudinal section view of the drill bit 12 showing one of the legs 16 and a central longitudinal axis 28 of the bit body 14. The bearing shaft 18 is cantilevered to extend inwardly from the leg 16. An interior cavity 30, or bit bowl, extends into the bit body 14 and is connected to the bore of a drill string for receiving drilling fluid which passes through the bit body 14 for cooling the drill bit 12, cleaning cuttings from cutters 20, and circulating upwards through the borehole with the cuttings. Flow passages 36 provide air holes or grease holes which extend from the interior cavity 30 to the ball port 50. A flow passage 38 is defined by a pilot hole which extends from the ball port 50 to the terminal end of the bearing shaft 18 located at a thrust bearing 56. The bearing shaft 18 provides a spindle on which the rotary cutter 20 is rotatably mounted. The shaft 18 preferably has a main portion 40 and a pilot portion 42. The outer bearings 44 are provided on the main portion 42, preferably provided by roller bearings. Inner bearings 46 are provided on the pilot portion 42 of the shaft 18, preferably provided by roller bearings. Ball bearings 48 lock the cutters 20 onto the bearing shafts 18 in conventional fashion. A ball plug 52 retains the ball bearings 48 between the bearing races of the shaft 18 and the cutter 20. A weld 62 secures the ball plug 52 to the leg 16 of the bit body 14. The ball plug 52 has a tapered portion 54 for fluid to flow from the flow passage 36 to the flow passage 38 in the ball port 50. A thrust bearing 56 is located at the outward end of the bearing shaft 18. An intermediate space 58 is located between the bearing shaft 18 and the cutter 20, provided by clearances between the shaft 18 and the cutter 20. The outer bearings 44, the inner bearings 46, the ball bearings 48 and the thrust bearing 56 are located within the intermediate space 58.

Figure 3:
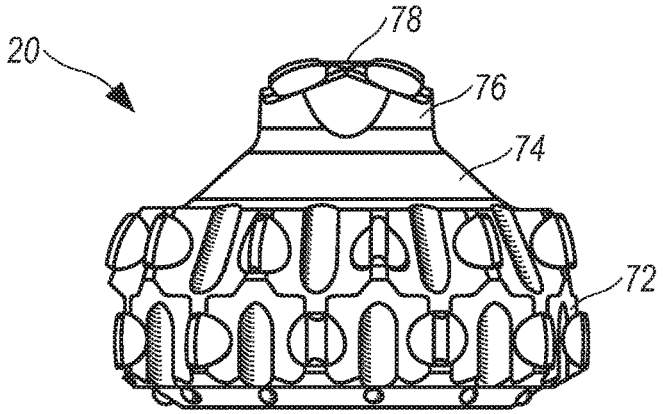
Figure 4:
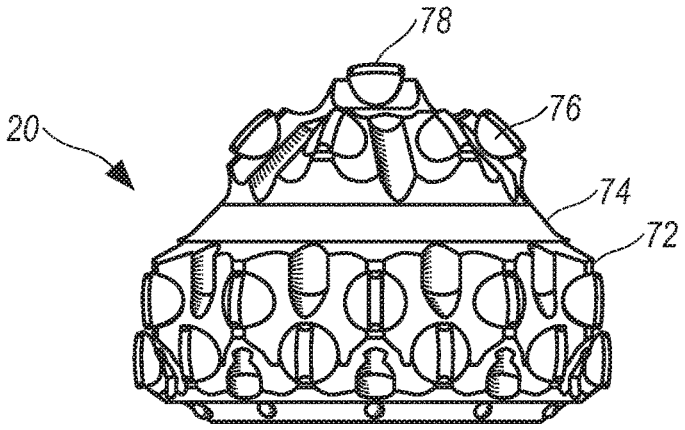
Figure 5:
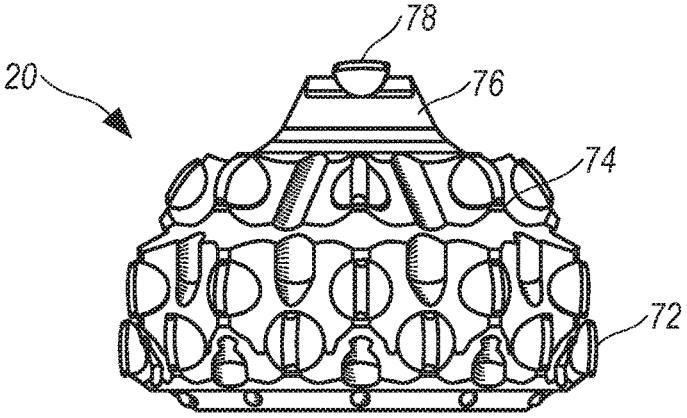

FIGS. 3, 4 and 5 are side views of cutters 20 for the drill bit 12. The rotary cutters 20 are hollow shells having a generally frustoconical shape. The cutters 20 each have a heel 72, and intermediate portion 74, a nose 76, and a tip 78 defined on the end of the nose 76. The teeth 22 are arranged in rows which circumferentially extend around different circumferences of the cutters 20. The different cutters 20 have different parts of the intermediate portions 76 and the nose 74 on which there are not teeth 22 to prevent interference between teeth 22 of adjacent cutters 20. FIG. 3 shows two rows of teeth 22 adjacent the heel 72, no rows of teeth 22 in the intermediate portion 74 and on the nose 76, and two teeth in opposite sides of the tip. FIG. 4 shows two rows of the teeth 22 on the heel 72, no teeth 22 at the intermediate portion 74, and one row of the teeth 22 on the nose 76, and a single tooth 22 on the tip 78. Additionally, the cutter 20 of FIG. 3 has two teeth 22 on the end or the tip 78 of the nose 76, and the cutters 20 of FIGS. 4 and 5 have only one tooth 22 each on the tips 78 of the respective noses 76 to prevent interference between the cutters 20.

Figure 6:
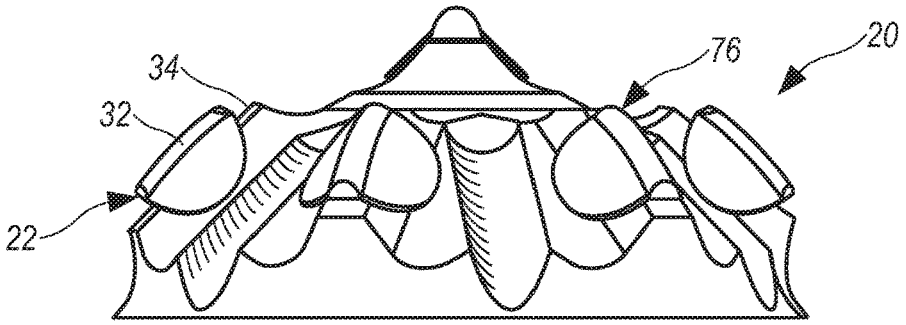
Figure 7:
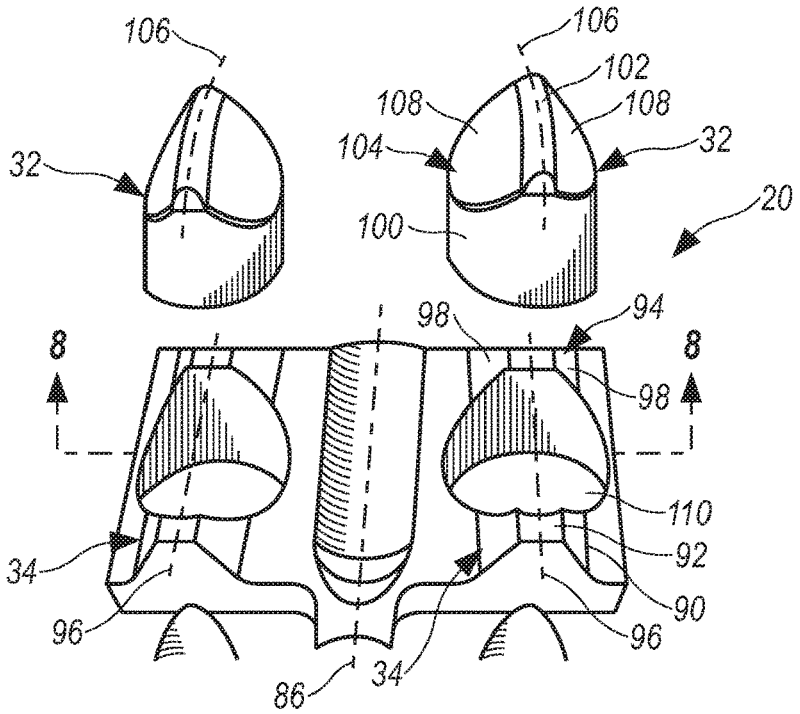

FIGS. 6 and 7 are fragmentary partial views of the cutter 20 of FIG. 4. FIG. 6 is a side view of the nose 76 and FIG. 7 is a fragmentary exploded view of a portion of the nose 76. The cutter 20 of FIG. 4 has the teeth 22 which circumferentially extends around the nose 76. The teeth 22 each include the milled tooth 34 and the tungsten carbide insert 32. Recesses 84 are defined by grooves extending into the cutter 20 between respective ones of the milled teeth 34. The recesses 84 have a generally elongate shape having a centrally located, longitudinal axis 86. The milled teeth 34 have a base 90, a crest 92, and sides which together define a milled tooth profile 94. The crests 92 are of a generally elongate form defining longitudinal axes 96 for the crests 92. The milled tooth profile 94 is formed for cutting and defines oppositely facing flanks 98 which extending generally transverse to the direction of rotation of the cutter 20. An insert socket 110 is defined by hole formed into the crests. The inserts 34 have a base 100, a crest 102, and sides 104 which together define an insert profile 104. The crests 102 are of a generally elongate form defining longitudinal axes 106 for the crests 102. The insert profile 104 is formed for cutting and defines oppositely facing flanks 108 which extending generally transverse to the direction of rotation of the cutter 20. The inserts 32 are fixedly secured in respective ones of the milled teeth 34.

Preferably, the longitudinal axes 86, 96 and 106 extend in adjacent relation to one another, in a generally parallel arrangement. It should be noted that the axes 86, 96 and 106 in general will be further from being parallel with increased curvature of the particular circumference of the cutter 20 on which the row of teeth 22 defining the axes 86, 96 and 106 are included. In some embodiments, the axes 86, 96 and 106 may extend perpendicular to the circumference 112 (shown in FIG. 8) of the cutter 20, and in other embodiments the axes may be at an angle from perpendicular to the circumference of the particular cutter 20. Each of the above is herein defined to extend in substantially adjacent relation and to be a generally parallel arrangement, although not perfectly parallel.

Figure 8:
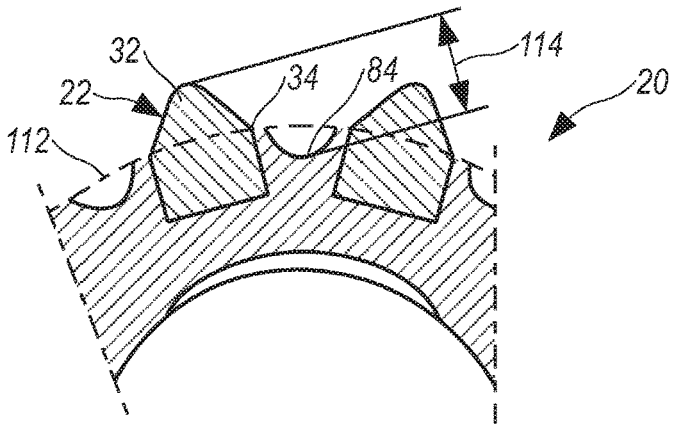

FIG. 8 is sectional view of the fragmentary portion of the cuter 20 shown in FIG. 7, taken along section line 8-8 of FIG. 7. The base 100 of the insert 32 is shown fitting within the socket 110. The profiles 104 of the inserts 32 are shown as being flush with the profiles 94 of the milled teeth 34. The recess 84 is shown extending adjacent to and substantially parallel with the teeth 22. The recess 84, the insert 32 and the milled tooth 34 have an effective tooth height 114 to provide a more aggressive rotary rock bit 12 with more material from the milled tooth 34 about the insert 32, providing both more support for the insert 32 and a more aggressive bit with the longer length 114.

The rotary cutters 20 are first formed by milling the teeth 34 into a conical cutter body. Then hard facing is preferably applied to the teeth 34. Next the cutter 20 will be heat treated followed by the holes being drilled to provide the insert sockets 110. The bases 100 of the tungsten carbide inserts 32 are then fixedly secured in the sockets 110.

The present invention provides advantages of a tungsten carbide rotary drill bit having milled teeth. The milled teeth are formed to be used as cutting surface in conjunction with the tungsten carbide inserts which provides a maximum amount of support metal around the insert. The additional metal limits stress on the insert, and also provides additional metal in the nose of the bit to deter bit failure due to erosion. The recesses extending in adjacent alignment with the teeth extend the effective height of the teeth, providing for a more aggressive geometry for the rotary cone drill bit.

Although the disclosed embodiment is for air drilling, other embodiments contemplate use of other drilling such as water based and oil based fluids. Sealed and lubricated bearings may be used, as is well known for rotary cone rock bits.

Although the preferred embodiment has been described in detail, it should be understood that various changes, substitutions and alterations can be made therein without departing from the spirit and scope of the invention as defined by the appended claims.

What is claimed is:

1. An earth boring bit comprising:

a bit body having at least one downwardly extending leg;

a bearing shaft cantilevered from said bit body;

a rotary cutter mounted for rotating on said bearing shaft;

a plurality of milled teeth formed in circumferentially extending rows about said cutter, each of said plurality of milled teeth having a tooth body which includes a base, a crest and sides, said sides defining oppositely facing flanks which extend generally transverse to a direction of rotation of said cutter, said flanks extending from said base to said crest which together define a milled tooth profile, and said tooth body further including an insert socket formed to extend through said crest and into said tooth body;

inserts having an insert base, an insert crest and insert sides extending from said insert base to said insert crest which together define an insert profile, wherein for each of said plurality of milled teeth a respective one of said inserts is mounted within said insert socket and extends outward of said tooth body from said crest, with said insert profile aligned in complimentary relation to said milled tooth profile such that said insert profile and said milled tooth profile both together define an effective tooth height and provide cutting engagement for said cutter; and elongate recesses formed to extend between adjacent ones of said milled teeth, aligned with said adjacent ones of said milled teeth.

2. The earth boring bit according to claim 1, wherein said crests of said milled teeth have a longitudinal crest length, respectively, said insert crests have an insert longitudinal crest length which extends in adjacent relation to said longitudinal crest length of a respective one of said milled teeth in which said insert is mounted.

3. The earth boring bit according to claim 2, wherein said elongate recesses each have a recess longitudinal axis which extends in adjacent relation with said insert longitudinal crest length and longitudinal crest length of adjacent ones of said inserts and said milled teeth.

4. The earth boring bit according to claim 1, wherein each of said insert profiles extend substantially parallel to a respective one of said milled tooth profiles corresponding to said milled tooth in which respective ones of said inserts are mounted.

5. The earth boring bit according to claim 4, wherein respective ones of said insert crests extend spaced apart from said crest of a respective one of said milled teeth to which said respective insert is mounted.

6. The earth boring bit according to claim 1, wherein said inserts are formed such that said insert profile has a chisel shape.

7. The earth boring bit according to claim 1, wherein said cutter and said milled teeth are formed of steel.

8. An earth boring bit comprising:

a bit body having at least one downwardly extending leg;

a bearing shaft cantilevered from said bit body;

a cutter mounted for rotating on said bearing shaft;

a plurality of milled teeth formed in circumferentially extending rows about circumferences of said cutter and extending, relative to respective ones of said circumferences, in substantially parallel relation to adjacent ones of said milled teeth, each of said plurality of milled teeth having a tooth body which includes a base, a crest and sides, said sides defining oppositely facing flanks which extending generally transverse to a direction of rotation of said cutter, said flanks extending from said base to said crest which together define a milled tooth profile, said crest being elongated to define a longitudinal crest length, and said tooth body further including an insert socket formed to extend through said crest and into said tooth body;

tungsten carbide inserts having an insert base, an insert crest and insert sides extending from said insert base to said insert crest which together define an insert profile, said insert crest being elongated to define an insert longitudinal crest length, wherein for each of said plurality of milled teeth a respective one of said tungsten carbide inserts is mounted within said insert socket and extends outward of said tooth body from said crest, with said insert profile aligned in complimentary relation to said milled tooth profile with said insert crest longitudinal length extending adjacent to said longitudinal crest length, such that said insert profile and said milled tooth profile both together define an effective tooth height and provide cutting engagement for said cutter; and elongate recesses formed to extend between adjacent ones of said milled teeth, aligned with said adjacent ones of said milled teeth.

9. The earth boring bit according to claim 8, wherein said elongate recesses each have a recess longitudinal axis which extends in substantially adjacent relation, substantially parallel with said longitudinal crest length and said insert longitudinal crest length of adjacent ones of said tungsten carbide inserts and said milled teeth.

10. The earth boring bit according to claim 8, wherein each of said insert profiles extend substantially parallel to a respective one of said milled tooth profiles corresponding to said milled tooth in which respective ones of said inserts are mounted.

11. The earth boring bit according to claim 10, wherein respective ones of said insert crests extend spaced apart from said crest of a respective one of said milled teeth to which said respective insert is mounted.

12. The earth boring bit according to claim 8, wherein said tungsten carbide inserts are formed such that said insert profile has a chisel shape.

13. The earth boring bit according to claim 8, wherein said cutter and said milled teeth are formed of steel.

14. An earth boring bit comprising:

a bit body having at least one downwardly extending leg;

a bearing shaft cantilevered from said bit body;

a cutter mounted for rotating on said bearing shaft;

a plurality of milled teeth formed in circumferentially extending rows about circumferences of said cutter and extending, relative to respective ones of said circumferences, in substantially adjacent relation to adjacent ones of said milled teeth, each of said plurality of milled teeth having a tooth body which includes a base, a crest and sides, said sides defining oppositely facing flanks which extend generally transverse to a direction of rotation of said cutter, said flanks extending from said base to said crest which together define a milled tooth profile, said crest being elongated to define a longitudinal crest length, and said tooth body further including an insert socket formed to extend through said crest and into said tooth body;

tungsten carbide inserts having an insert base, an insert crest and insert sides extending from said insert base to said insert crest which together define an insert profile, said insert crest being elongated to define an insert longitudinal crest length, wherein for each of said plurality of milled teeth a respective one of said tungsten carbide inserts is mounted within said insert socket and extends outward of said tooth body from said crest, with said insert profile aligned in complimentary relation to said milled tooth profile with said insert crest longitudinal length extending adjacent to said longitudinal crest length, such that said insert profile and said milled tooth profile both together define an effective tooth height and provide cutting engagement for said cutter; and wherein each of said insert profiles extend substantially parallel to a respective one of said milled tooth profiles corresponding to said milled tooth in which respective ones of said inserts are mounted.

15. The earth boring bit according to claim 14, further comprising elongate recesses formed to extend between adjacent ones of said milled teeth, aligned with said adjacent ones of said milled teeth, wherein said elongate recesses each have a recess longitudinal axis which extends in substantially adjacent relation, substantially parallel with said longitudinal crest length and said insert longitudinal crest length of adjacent ones of said tungsten carbide inserts and said milled teeth.

16. The earth boring bit according to claim 15, wherein respective ones of said insert crests extend spaced apart from said crest of a respective one of said milled teeth to which said respective insert is mounted.

17. The earth boring bit according to claim 14, wherein said tungsten carbide inserts are formed such that said insert profile has a chisel shape.

18. The earth boring bit according to claim 14, wherein said cutter and said milled teeth are formed of steel.

* * * * *